US005222608A

United States Patent [19]

Eklof et al.

[11] Patent Number: 5,222,608

[45] Date of Patent: Jun. 29, 1993

[54] MERCHANDISE DISPLAY APPARATUS

[75] Inventors: Thomas E. Eklof; Walter M. Poterbin; Roger L. Fernandez, all of Santa Cruz County, Calif.

[73] Assignee: Santa Cruz Industries, Santa Cruz, Calif.

[21] Appl. No.: 899,425

[22] Filed: Jun. 16, 1992

[51] Int. Cl.[5] ..... A47F 7/00

[52] U.S. Cl. ..... 211/54.1; 211/57.1; 248/220.4

[58] Field of Search ..... 211/54.1, 57.1, 59.1, 211/51; 248/220.3, 220.4

[56] References Cited

U.S. PATENT DOCUMENTS 4,475,658 10/1984 Roberts ..... 211/54.1
4,821,894 4/1989 Dechirot ..... 211/54.1 X
4,869,376 9/1989 Valiulis et al. ..... 211/54.1 X
5,009,334 4/1991 Bodkins ..... 211/54.1
5,054,646 10/1991 Hammerschlag et al. .... 211/57.1 X
5,114,021 5/1992 Fredrickson ..... 211/54.1

*Primary Examiner*—Robert W. Gibson, Jr.
*Attorney, Agent, or Firm*—Flehr, Hohbach, Test, Albritton & Herbert

[57] ABSTRACT

Merchandise display apparatus is provided which is self-fronting in action. A peg hook is provided with a rod portion formed at its front end with a retainer which keeps products from unintentionally sliding off the hook. A push plate is mounted for traversing movement along the rod, and the plate is formed with a front surface which abuts the rear face of the product that is carried rearmost on the rod. A compression spring is provided to apply a yieldable force forward against the plate, thereby urging the products forward while being maintained in vertical orientation by the plate. The self-fronting action maintains a uniformly neat and attractive merchandise display.

16 Claims, 4 Drawing Sheets

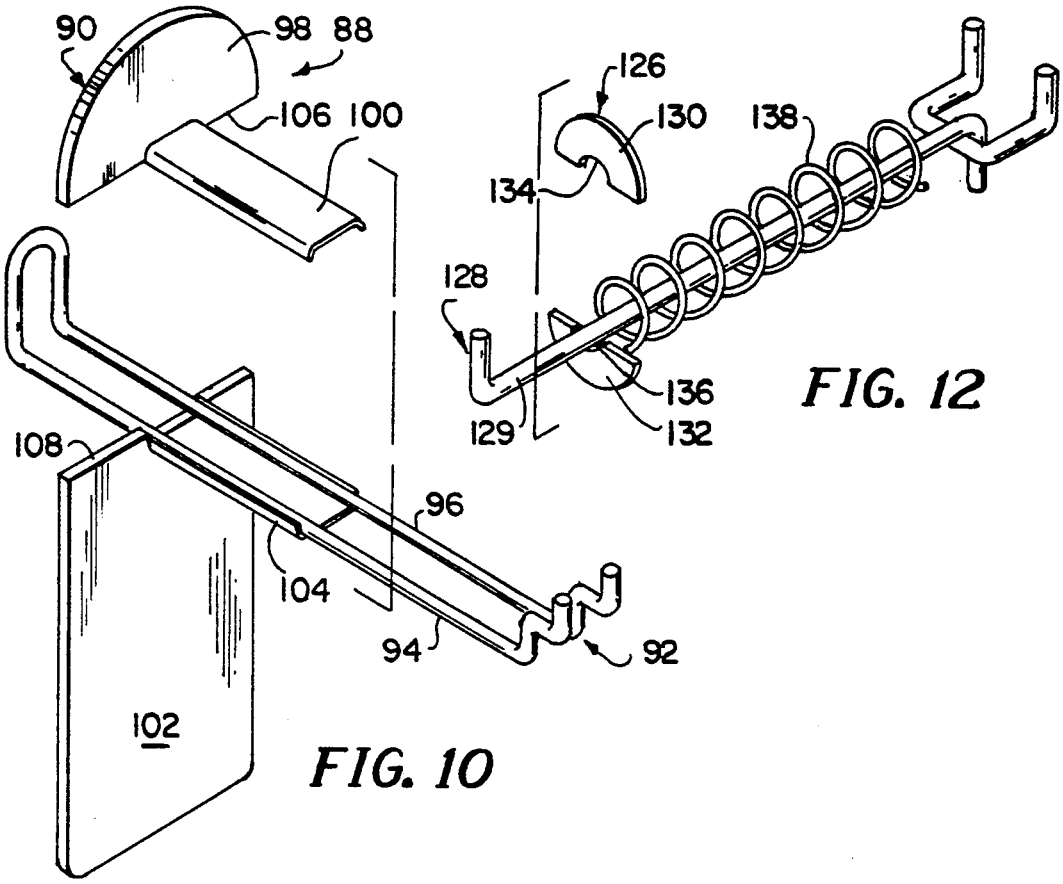
FIG. 12
FIG. 10
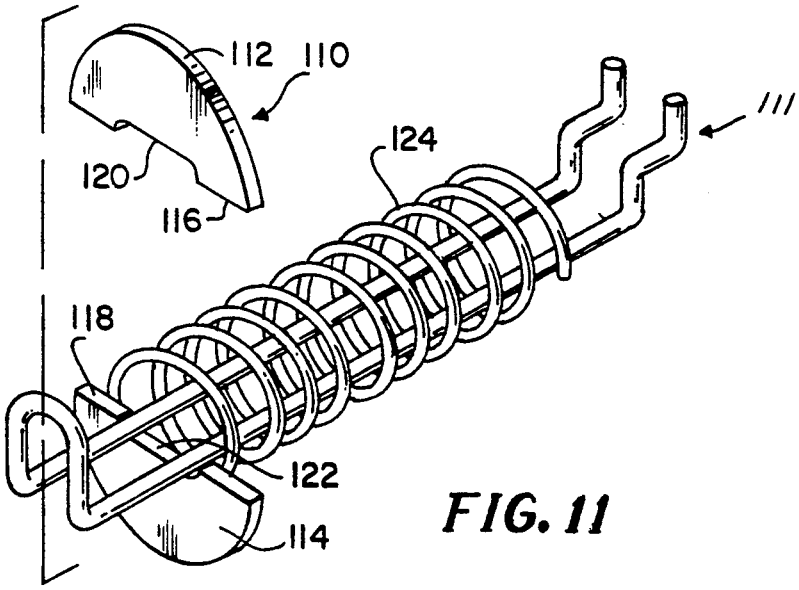
FIG. 11

MERCHANDISE DISPLAY APPARATUS

BACKGROUND OF THE INVENTION

1. Field of the Invention

This invention relates to merchandise display apparatus of the type in which products are carried on hooks attached to pegboards or other supports. Pegboard and hook assemblies of this type are typically used in retail stores and supermarkets for providing an attractive display of relatively small merchandise products.

For the retailer's convenience as well as to minimize theft, the products are usually packaged on card stock punched with holes for mounting on the pegboard hooks. The product and card stock is often contained in a clear plastic bubble or clamshell enclosure.

In the retail store the products, which include the typical card stock and/or plastic enclosure, are mounted on the pegboard hooks so that the customer can make a selection on a self-serve basis. The products, or the packaging containing them, typically have a relatively flat configuration with front and rear faces so that they hang vertically when the hook is inserted through the openings punched through the top of the card stock. The front end of the hook has a tip which is turned upwardly at a small angle on the order of 30° for temporarily retaining the product. The customer makes a selection by pulling off the product from the front of the hook. This eventually leads to an unsightly merchandise display in that the products remaining on the hooks make an uneven and unsightly visual presentation.

2. Background Art

It is well known to provide return mechanisms for use with pegboard displays in an effort to maintain uniformity in the appearance of the products on the display. Typically these prior return mechanisms employ springs which urge the products forwardly on the hooks as the product at the front is selected and withdrawn by the customer.

U.S. Pat. No. 4,475,658 to Roberts provides a spring-loaded merchandising device in which a conical compression spring is mounted about the hook with the base end of the spring adjacent the pegboard. The front end of the spring pushes against the products so that they are moved forwardly and temporarily retained by the upturned tip end of the rod. However, in an arrangement of this type the spring action is such that when viewed from one side a group of the cards tend to bunch together at the top in the manner of a fan. This is due to the configuration of the packaging in which the combined widths of the cards at the top is less than the combined widths of the bottom portions of the packaging. When the products are bunched together in this manner, the overall display is less attractive and detracts from the desired merchandizing appeal to the buyer.

U.S. Pat. No. 4,821,894 to Dechirot provides a return spring device for use with a double pin pegboard display. The double pegboard pins, also known as safety hooks, are characterized in having a pair of pins or rods which are joined together at the front by a curved portion which is designed to minimize injury to people, such as when someone may accidentally fall against the pegboard. In the patent the rearmost product is pulled forwardly by a tension spring which loops around a curved stud mounted between the forward ends of the pins. However, this arrangement also results in the undesirable fan-like bunching together at the top of the product packaging.

U.S. Pat. No. 5,009,334 to Bodkins provides an anti-pilferage fixture in which the product is pushed forwardly along a cage-like structure by means of a coil compression spring. This arrangement also results in the undesirable fan-like bunching of the product.

U.S. Pat. No. 4,869,376 to Valiulis provides a pegboard display device employing a wire bridge arranged to keep the products in a forward position on the hangar while preventing them from sliding rearwardly. A disadvantage to this arrangement is that the bridge must be manually moved forwardly as the product is withdrawn.

The need has therefore been recognized for a new and improved pegboard hook arrangement which automatically moves the product forwardly on the hooks while obviating the problem of bunching at the top to thereby maintain an attractive merchandise display.

OBJECTS AND SUMMARY OF THE INVENTION

It is general object of the invention to provide new and improved apparatus for displaying merchandise products on a pegboard or other support for maintaining a uniform attractive display appearance.

Another object is to provide display apparatus of the type described in which, as a customer selects and withdraws a product at the front of individual hooks, the remaining products are automatically pushed forward while being kept in vertical orientation to maintain an attractive merchandise display.

The invention in summary provides display apparatus which includes a hook mounted on a pegboard or other support and adapted to carry merchandise products in an upright orientation. The hook includes a rod portion having a distal end which is turned vertically upwardly for retaining the products against unintentional withdrawal. A push plate is mounted for traversing movement along the rod, and the front surface of the plate abuts the rear face of the product which is carried rearmost on the rod. A compression spring carried on the rod applies a yieldable force against the plate which in turn urges the products forward. The plate is held in a vertical orientation relative to the rod so that as the pushing force is applied the vertical orientation of the product is maintained. In one embodiment the plate includes a skirt which extends downwardly along the rear face of the product. In another embodiment the plate comprises a collar having a guide bore through which the rod is slidably mounted. In other embodiments the push plate is adapted for mounting on a safety hook of the type having a pair of laterally spaced-apart, parallel rods.

The foregoing and additional objects and features of the invention are set forth in more detail in the following description in which the several embodiments have been explained in conjunction with the accompanying drawings.

BRIEF DESCRIPTION OF THE DRAWINGS

FIG. 10 is a perspective view illustrating another embodiment of the display apparatus;

FIG. 11 is a perspective view illustrating another embodiment of the display apparatus;

FIG. 12 is a perspective view illustrating another embodiment of the display apparatus.

DESCRIPTION OF THE PREFERRED EMBODIMENTS

Figure 1:
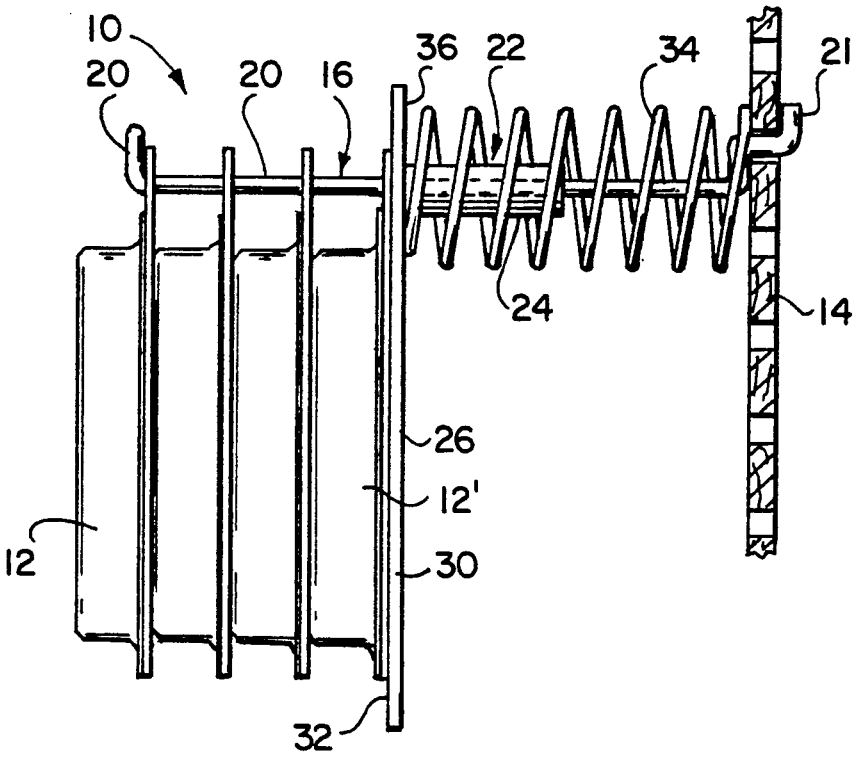
FIG. 1 is a side elevational view illustrating display apparatus according to one embodiment of the invention.
Figure 2:
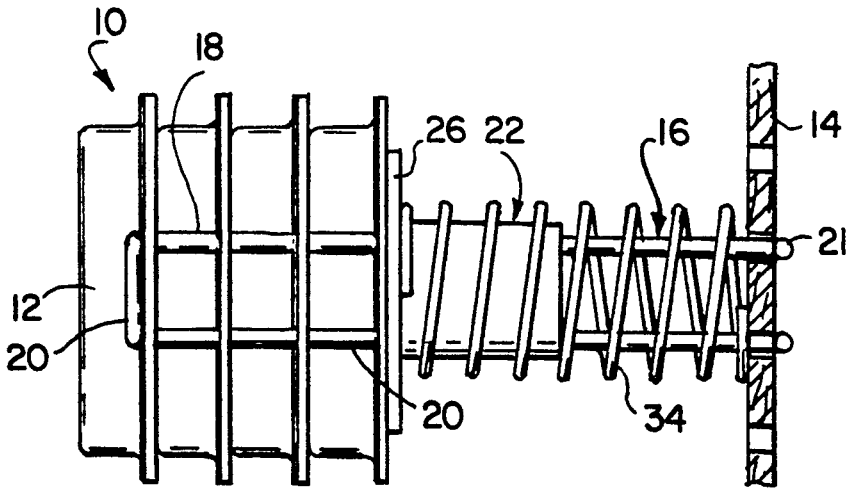
FIG. 2 is a top plan view of the display apparatus of FIG. 1.
Figure 3:
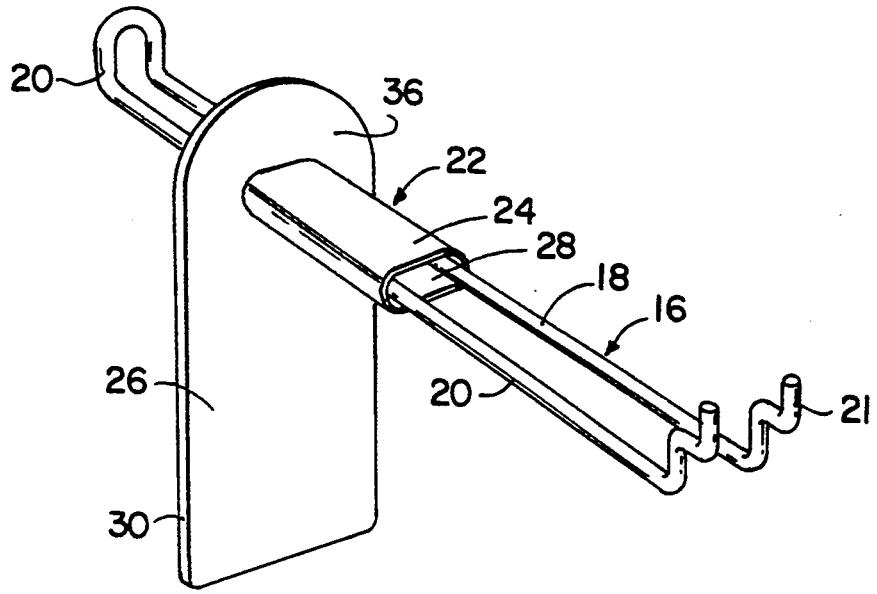
FIG. 3 is a perspective view of the hook and push plate components of the display apparatus of FIG. 1.

In the drawings FIGS. 1-3 illustrate generally at 10 apparatus for displaying merchandise products 12 on a pegboard 14 or other suitable support, such as a wire grid or slot wall. The products to be displayed are typically small merchandise items of the type sold in retail stores or supermarkets. The products are usually carried on card stock having holes or apertures punched at the top for mounting on pegboard hooks. The product, with or without the card stock, can be encased in a clear plastic enclosure, such as a plastic blister pack or clamshell package. As used herein the term "product" means merchandise items which can be mounted on pegboard hooks with or without packaging. The products, or the packaging containing them, have a generally flat configuration with front and rear faces such that a plurality of the products can be suspended vertically in the manner shown in FIG. 1.

Display apparatus 10 of the embodiment of FIGS. 1-3 is adapted for use with safety hook 16 of the type having a pair of laterally spaced-apart rod portions 18, 20. The rod portions are joined together at their distal ends by a curved tip 20. The tip is bent upright at an angle in the range of 30°-90°, and preferably 90°, to releasably hold the products against unintentionally sliding off the hook. To select and withdraw the product at the front, the customer lifts the bottom of the product up until the aperture at the top of the package clears the hook tip.

The proximal ends 21 of the rods of the safety hook are formed into two right angle bends in the manner of a typical pegboard hook. The proximal ends are inserted into and locked with selected holes in the wire grid, slot wall or pegboard, as best illustrated in FIG. 1.

As a customer selects and withdraws product at the front, the product at the rear is automatically pushed forward while being maintained in an upright orientation by means of push plate device 22. A best shown in FIG. 3, push plate device 22 is comprised of a sleeve 24 attached at its front end to a flat vertical push plate 26. The sleeve and push plate can advantageously be integrally molded as a unit from a suitable synthetic plastic material. The sleeve 24 is formed with a guide bore 28 having an oval cross-section sized to envelope the hook rod portions 18 and 20. The sleeve slidably moves along the rod portions to thereby traverse the push plate along the length of the hook. The push plate includes a skirt 30 which extends vertically downwardly from sleeve 24. The skirt is formed with a generally flat front surface 32 which abuts in contact with the rear face of the product 12' that is carried rearmost on the rod portions. The sleeve stabilizes and holds the push plate in an upright orientation as it traverses to thereby keep the product upright.

A yieldable force is applied forwardly against the push plate by means of a coiled compression spring 34. The spring is coaxially mounted about the proximal end of the hook as well as sleeve 22, and the front end of the hook is anchored against the plate base portion 36 which surrounds the circumference of the sleeve. The inner end of the spring is supported by suitable means such as the pegboard or peg hook.

In the use and operation of display apparatus 10, the product is loaded onto the hook by manually slipping the punched-out opening at the top of the product card over hook tip 20. As individual products are loaded, plate 26 is pushed back to compress spring 34. When the loading is completed the spring force acts against plate 26 which pushes the products together. The pushing force is applied by the plate to the vertical midportion of the product to maintain the abutting contact. At the same time, the card of the front product is retained by the hook tip. The vertically straight orientation of the push plate, which is maintained vertical by the guide sleeve, keeps the product in a neat and orderly vertical relationship, as shown in FIG. 1. As a customer selects and withdraws a product from the front, the spring force and push plate move the remaining products forwardly while maintaining their vertical orientation. When used with a plurality of hooks on a single pegboard, the action of apparatus 10 maintains an attractive display in that the products on each of the hooks are uniformly at the front and in vertical alignment. The self-fronting action of the invention also results in a saving of labor in that the retail clerks do not have to spend the time that would otherwise be required to periodically straighten the product stock on the displays.

Figure 4:
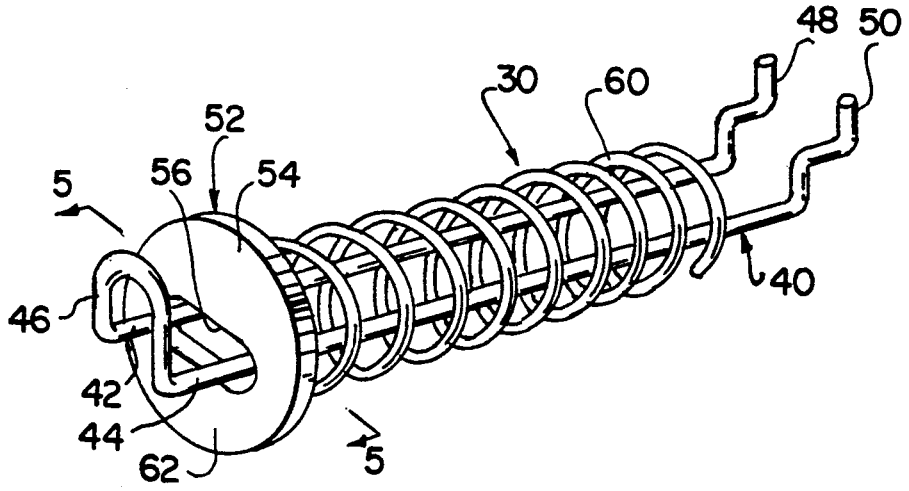
FIG. 4 is a perspective view illustrating display apparatus according to another embodiment of the invention.
Figure 5:
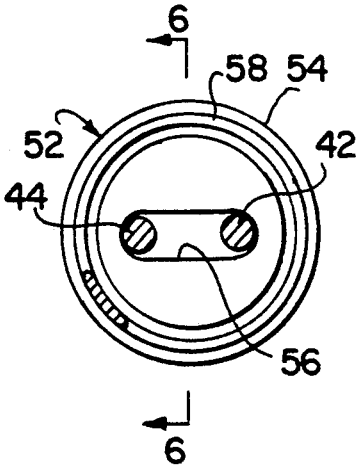
FIG. 5 is a cross-sectional view taken along the line 5—5 of FIG. 4.
Figure 6:
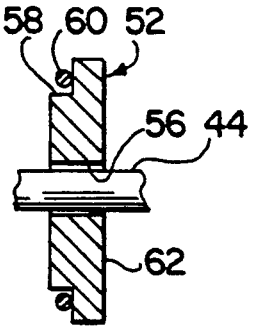
FIG. 6 is an axial section view taken along the line 6—6 of FIG. 5.

FIGS. 4-6 illustrate display apparatus 38 according to another embodiment of the invention adapted for use with safety hook 40. The safety hook is of the type described for the embodiment of FIG. 1 and includes a pair of rod portions 42, 44 joined together at their distal ends by an upright curved tip 46. The proximal ends of the rod portions are formed with double bent ends 48, 50 adapted for insertion into the openings or slots of a wire grid, slot wall or pegboard.

A push plate 52 is mounted for traversing movement along the rod portions. Plate 52 is comprised of an annular collar 54 formed with a guide bore 56 of oval cross-section. As best shown in FIG. 5, the guide bore is sized and proportioned to encompass the pair of rods, and sufficient clearance is provided so that the collar is free to traverse along the rods. A circular groove 58 is machined around the inner rim of the collar. A coiled compression spring 60 is mounted about the two rod portions, with the distal end of the spring anchored in collar groove 58. The proximal end of the spring is supported against the wire grid, slot wall or pegboard, as the case may be.

The axial length of guide bore 56 functions in the manner of the sleeve of the embodiment of FIG. 1 by cooperating with the hook rod to hold collar 54 in vertical orientation as it traverses the rod. The flat side 62 of the collar has a peripheral margin with an area sized sufficient to bear on and apply a pushing force against the rearmost product (not shown). The surface area of flat side 62 is sufficient to hold the product in its upright orientation as the force from the spring urges the collar and product forwardly.

Figure 7:
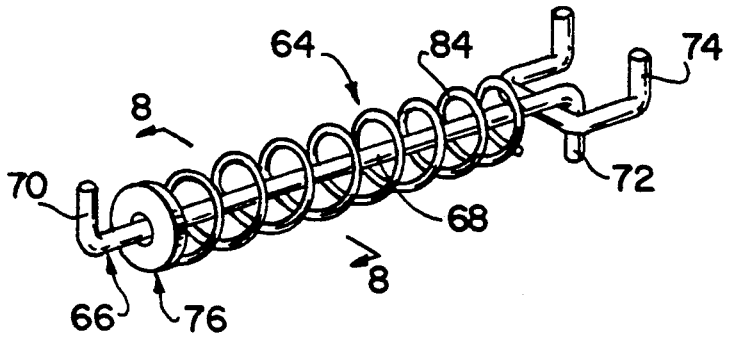
FIG. 7 is a perspective view illustrating display apparatus according to another embodiment of the invention.
Figure 8:
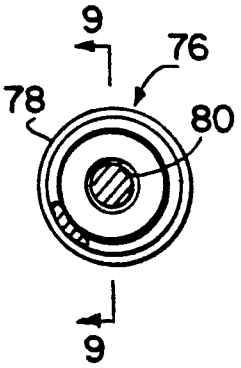
FIG. 8 is a cross-sectional view taken along the line 8—8 of FIG. 7.
Figure 9:
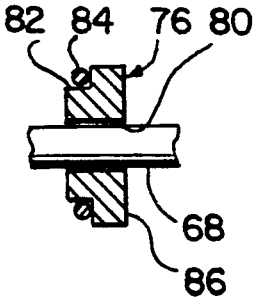
FIG. 9 is an axial section view taken along the line 9-10 of FIG. 8.

FIGS. 7-9 illustrates display apparatus 64 according to another embodiment adapted for use with a pegboard hook 66 having a single rod portion 68. The distal end of the rod portion is formed with a tip 70 turned up at an angle in the range of 30°-90°, and preferably 90°. Tip 70 retains the product against unintentional removal. The proximal end of the rod portion is formed with a down-turned end 72 across which a wire clip 74 is secured as by welding. The ends of the wire clip are turned upwardly and are adapted for insertion into adjacent holes in a pegboard (not shown). With the wire clip inserted, the rod portion extends horizontally outwardly from the pegboard.

A push plate 76 is mounted for traversing movement along the rod portion. The push plate comprises an annular collar 78 which is formed with a coaxial circular guide bore 80. The guide bore is sized to slidably fit over rod portion 68, and the length of the bore is sufficient to hold the collar in upright orientation. A groove 82 is formed about the outer periphery of the collar for anchoring the distal end of a coiled compression spring 84. The proximal end of the spring is supported against the pegboard. The flat outer side 86 of the collar has a peripheral margin which abuts the rear face of the product (not shown) carried rearmost on the rod. The area of the peripheral margin is sized sufficient to hold the product in upright orientation as the spring force is applied. As customers remove products from the front of the display, the self-fronting action of the spring and collar in keeping the remaining product vertical achieves a uniformly neat and attractive merchandise display.

FIG. 10 illustrates display apparatus 88 which incorporates a two-part push plate device 90. Display apparatus 88 is adapted for use with a safety hook 92 having a pair of spaced-apart rod portions 94, 96 similar to the embodiment of FIGS. 1-3. Push plate device 90 is comprised of a pair of snap-together top and bottom components for fast and convenient assembly on and disassembly from the safety hook. The top component is comprised of a semicircular push plate 98 joined with an elongate downwardly concave sleeve portion 100 which is sized to slidably fit over the top sides of the hook rod portions. The bottom component is comprised of a vertical skirt 102 joined with an elongate upwardly concave sleeve portion 104 which is sized to fit underneath the rod portions. With the top and bottom components joined together in the manner illustrated by the broken lines in the drawing, the lower edge 106 of the push plate abuts the upper edge 108 of the skirt, while the corresponding side edges of the two sleeve portions abut together. The combined sleeve portions form a channel through which the rod portions slide. Suitable snap-fit connection means, not shown, is provided to hold the two parts together. For example, a pin-in-hole snap-fit connection can be used for this purpose.

With the upper and lower components joined together push plate device 90 is structurally similar to and functions in the manner explained for the push plate device of the embodiment of FIGS. 1-3. A suitable compression spring, not shown, is placed over safety hook 92 and the sleeve portions to apply the yieldable force against the push plate and skirt.

FIG. 11 illustrates display apparatus according to another embodiment providing a two-part push plate device 110 which is also adapted for use with a safety hook 111 as described for the embodiment of FIGS. 4-6. Push plate device 110 is comprised of upper and lower semicircular plates 112, 114 having facing diametrical edges 116, 118. Oval cut-outs or channels 120, 122 are formed along the facing edges so as to slidably fit about the rod portions of safety hook 111. With the two plates joined together in the manner illustrated by the broken lines in the drawing, a circular push plate is formed which slides back and forth along the rod portions under influence of compression spring 124. A suitable snap-fit connection, not shown, is provided to hold the two plates together. FIG. 12 illustrates another embodiment providing a two-part push plate device 126 which is adapted for use with a pegboard hook 128 having a single rod portion 129. Device 126 is comprised of a pair of semicircular plates 130, 132 having facing diametrical edges. Semicircular cut-outs or channels 134, 136 are formed in the facing edges so as to slidably fit about rod portion 129. With the two plates joined together as shown by the broken lines in the drawing, a combined push plate is formed which operates similar to the push plate device of the embodiment of FIGS. 7-9. The combined push plate slides back and forth along the rod portion under influence of compression spring 138.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. Apparatus for displaying merchandise products on a pegboard or other support in which the products or the packaging containing them have a configuration with front and rear faces, the apparatus comprising the combination of hook means for carrying one or more of the products with the front and rear faces thereof in an upright orientation, said hook means including an elongate rod portion for slidably suspending products thereon, said rod portion having a proximal end secured to the pegboard or other support and a distal end projecting forwardly therefrom, retainer means for releasably retaining products against unintentionally sliding off from the distal end of the rod portion, push plate means mounted for traversing movement along the rod portion, said push plate means including a plate having a front surface oriented to abut in contact with the rear face of the product which is carried rearmost on the rod portion, means for holding the plate in a substantially vertically downwardly extending orientation relative to the rod portion and for causing the plate to apply a pushing force to the vertical midportion of the product for maintaining said abutting contact with the rear face of the product as the push plate means traverses along the rod portion, and spring means carried on the rod portion for applying a yieldable force in a forward direction against the plate and thereby urge the products forward when a product at the front is removed while maintaining said upright orientation of the products.

2. Apparatus for displaying merchandise products on a pegboard or other support in which the products or the packaging containing them have a configuration with front and rear faces, the apparatus comprising the combination of hook means for carrying one or more of the products with the front and rear faces thereof in an upright orientation, said hook means including an elongate rod portion for slidably suspending products thereon, said rod portion having a proximal end secured to the pegboard or other support and a distal end projecting forwardly therefrom, retainer means for releasably retaining products against unintentionally sliding off from the distal end of the rod portion, push plate means mounted for traversing movement along the rod portion, said push plate means including a plate having a front surface oriented to abut in contact with the rear face of the product which is carried rearmost on the rod portion, means for holding the plate in a substantially vertically downwardly extending orientation relative to the rod portion and for causing the plate to apply a pushing force to the vertical midportion of the product for maintaining said abutting contact with the rear face of the product as the push plate means traverses along the rod portion, said means for holding the plate includes a sleeve secured to the plate and having a guide bore coaxial with and mounted about the rod portion for slidable movement therealong, and spring means carried on the rod portion for applying a yieldable force in a forward direction against the plate and thereby urge the products forward when a product at the front is removed while maintaining said upright orientation of the products.

3. Apparatus for displaying merchandise products on a pegboard or other support in which the products or the packaging containing them have a configuration with front and rear faces, the apparatus comprising the combination of hook means for carrying one or more of the products with the front and rear faces thereof in an upright orientation, said hook means including an elongate rod portion for slidably suspending products thereon, said rod portion having a proximal end secured to the pegboard or other support and a distal end projecting forwardly therefrom, retainer means for releasably retaining products against unintentionally sliding off from the distal end of the rod portion, push plate means mounted for traversing movement along the rod portion, said push plate means including a plate having a front surface oriented to abut in contact with the rear face of the product which is carried rearmost on the rod portion, said plate comprises an annular collar having a guide bore slidably mounted about the rod portion, said collar having a peripheral margin with an area sized sufficient to bear on and apply a pushing force against the product carried on the rod portion, means for holding the plate in a substantially vertically downwardly extending orientation relative to the rod portion and for causing the plate to apply a pushing force to the vertical midportion of the product for maintaining said abutting contact with the rear face of the product as the push plate means traverses along the rod portion, and spring means carried on the rod portion for applying a yieldable force in a forward direction against the plate and thereby urge the products forward when a product at the front is removed while maintaining said upright orientation of the products.

4. Apparatus for displaying merchandise products on a pegboard or other support in which the products or the packaging containing them have a configuration with front and rear faces, the apparatus comprising the combination of hook means for carrying one or more of the products with the front and rear faces thereof in an upright orientation, said hook means including an elongate rod portion for slidably suspending products thereon, said rod portion having a proximal end secured to the pegboard or other support and a distal end projecting forwardly therefrom, said rod portion comprises a pair of rods extending from the pegboard or support in parallel, laterally spaced-apart relationship, retainer means for releasably retaining products against unintentionally sliding off from the distal end of the rod portion, push plate means mounted for traversing movement along the rod portion, said push plate means including a plate having a front surface oriented to abut in contact with the rear face of the product which is carried rearmost on the rod portion, and spring means carried on the rod portion for applying a yieldable force in a forward direction against the plate and thereby urge the products forward when a product at the front is removed while maintaining said upright orientation of the products.

5. Apparatus for displaying merchandise products on a pegboard or other support in which the products or the packaging containing them have a configuration with front and rear faces, the apparatus comprising the combination of hook means for carrying one or more of the products with the front and rear faces thereof in an upright orientation, said hook means including an elongate rod portion for slidably suspending products thereon, said rod portion having a proximal end secured to the pegboard or other support and a distal end projecting forwardly therefrom, retainer means for releasably retaining products against unintentionally sliding off from the distal end of the rod portion, push plate means mounted for traversing movement along the rod portion, said push plate means including a plate having a front surface oriented to abut in contact with the rear face of the product which is carried rearmost on the rod portion, said plate is comprised of a first plate portion having a side formed with a first channel and a second plate portion having a side formed with a second channel, and means for fitting the first and second plates together with the first and second channels thereof enclosing said rod portion for slidable movement therealong, and spring means carried on the rod portion for applying a yieldable force in a forward direction against the plate and thereby urge the products forward when a product at the front is removed while maintaining said upright orientation of the products.

6. Apparatus as in claim 1 in which said plate includes a skirt which extends downwardly from the rod portion, said skirt forming said front surface which abuts the rear face of the product carried rearmost on the rod portion.

7. Apparatus as in claim 2 in which said plate has a base portion which extends around the outer circumference of the sleeve, and the spring means comprises a coil spring coaxially mounted around the rod portion, said coil spring having an inner end which is supported by the pegboard and an outer end which is anchored against the base portion of the plate.

8. Apparatus as in claim 1 in which said retainer means includes an upright tip formed on the distal end of the rod portion for releasably retaining products against unintentionally sliding off from the distal end of the rod portion.

9. Apparatus as in claim 1 in which said collar has a peripheral margin, said spring means comprises a coil spring coaxially mounted around the rod portion, and said coil spring has an outer end which is anchored against the peripheral margin of the collar.

10. Apparatus as in claim 4 in which said push plate means includes means for holding the plate in a substantially vertically downwardly extending orientation relative to the rod portion and for causing the plate to apply a pushing force to the vertical midportion of the product for maintaining said abutting contact with the rear face of the product as the push plate means traverses along the rod portion.

11. Apparatus as in claim 10 in which said means for holding the plate includes a sleeve secured to the plate and having a guide bore with an oval cross section sized and proportioned sufficient to encompass the pair of rods for slidable movement therealong.

12. Apparatus as in claim 11 in which said plate has a base which extends around the outer circumference of the sleeve, and the spring means comprises a coil spring coaxially mounted around the pair of rods, said coil spring having an outer end which is anchored against the base of the plate.

13. Apparatus as in claim 10 in which said plate comprises a collar having an oval guide bore which is slidably mounted about the rod portion, said collar having a peripheral margin with an area sized sufficient to bear on and apply a pushing force against the product carried on the rod portion.

14. Apparatus as in claim 13 in which said spring means comprises a coil spring coaxially mounted around the rod portion, said coil spring having an outer end which is anchored against the peripheral margin of the collar.

15. Apparatus as in claim 4 in which said retainer means includes an upright tip formed on the distal end of the rod portion for releasably retaining products against unintentionally sliding off from the distal end of the rod portion.

16. Apparatus as in claim 2 in which said plate is comprised of a first plate portion and a second plate portion, said sleeve is comprised of a first sleeve portion joined with the first plate portion and second sleeve portion formed with the second plate portion, said first plate portion and first sleeve portion being formed with a first channel sized to slidably fit at least partially about said rod portion, said second plate portion and said second sleeve portion being formed with a second channel being sized to slidably fit at least partially fit about said rod portion, and means for joining said plate portions and sleeve portions together with the rod portion extending through the channels for slidable relative movement therealong.

* * * * *